United States Patent [19]

Blazso

[11] 4,394,407

[45] Jul. 19, 1983

[54] METHOD FOR THE MANUFACTURE OF A LAYER FROM A THERMOCHROME LACQUER, AND ITS USE

[75] Inventor: Eva Blazso, Baar, Switzerland

[73] Assignee: LGZ Landis & Gyr Zug AG, Zug, Switzerland

[21] Appl. No.: 233,783

[22] PCT Filed: Mar. 21, 1980

[86] PCT No.: PCT/CH80/00039

§ 371 Date: Feb. 12, 1981

§ 102(e) Date: Feb. 12, 1981

[87] PCT Pub. No.: WO81/00084

PCT Pub. Date: Jan. 22, 1981

[30] Foreign Application Priority Data

Jun. 27, 1979 [CH] Switzerland ..... 5987/79

[51] Int. Cl.[3] ..... B41M 3/12

[52] U.S. Cl. ..... 427/150; 427/386; 428/913

[58] Field of Search ..... 427/146, 150, 386; 428/913

[56] References Cited

U.S. PATENT DOCUMENTS 3,178,306 4/1965 Wark ..... 428/913

FOREIGN PATENT DOCUMENTS 943544 12/1963 United Kingdom ..... 427/150

1029735 5/1966 United Kingdom .

*Primary Examiner*—Norman Morgenstern
*Assistant Examiner*—Janyce A. Bell
*Attorney, Agent, or Firm*—Ernest F. Marmorek

[57] ABSTRACT

A mixture of two to three ingredients, which ingredients may be stored on their own, are used for the manufacture of a thermochrome lacquer. The first ingredient is a compound of heavy metal or noble metal dispersed in a resin base solution, the second ingredient is a sulfur/carbon-covalent compound dispersed in the resin base solution, or in a hardener for the resin base, and the third ingredient, if required, is the hardener. The resin base is related to the hardener, and the metal compound to the sulfur/carbon covalent compound in respective stochiometric ratios. The metal compound is a metal compound of an oxide forming metal sulfide compounds with the sulfide ions, the metal sulfide compounds being irreversibly darkened, or a metal compound of an inorganic anion, or a metal compound of a monocarboxylic acid, or a metal compound of a dicarboxylic acid. The resin base consists of a prepolymerizate of a methacrylic acid, or of a glycide lather, and the hardener consists of a diol or an amine. The thermochrome layer has a thickness of 10 to 100 μm, and experiences a irreversibly local darkening by a heated heating element. The layers from the lacquer are used on card-shaped payment means having optical markings, which are thermally erasable, and whose erasure is indicated by blackening.

6 Claims, 1 Drawing Figure

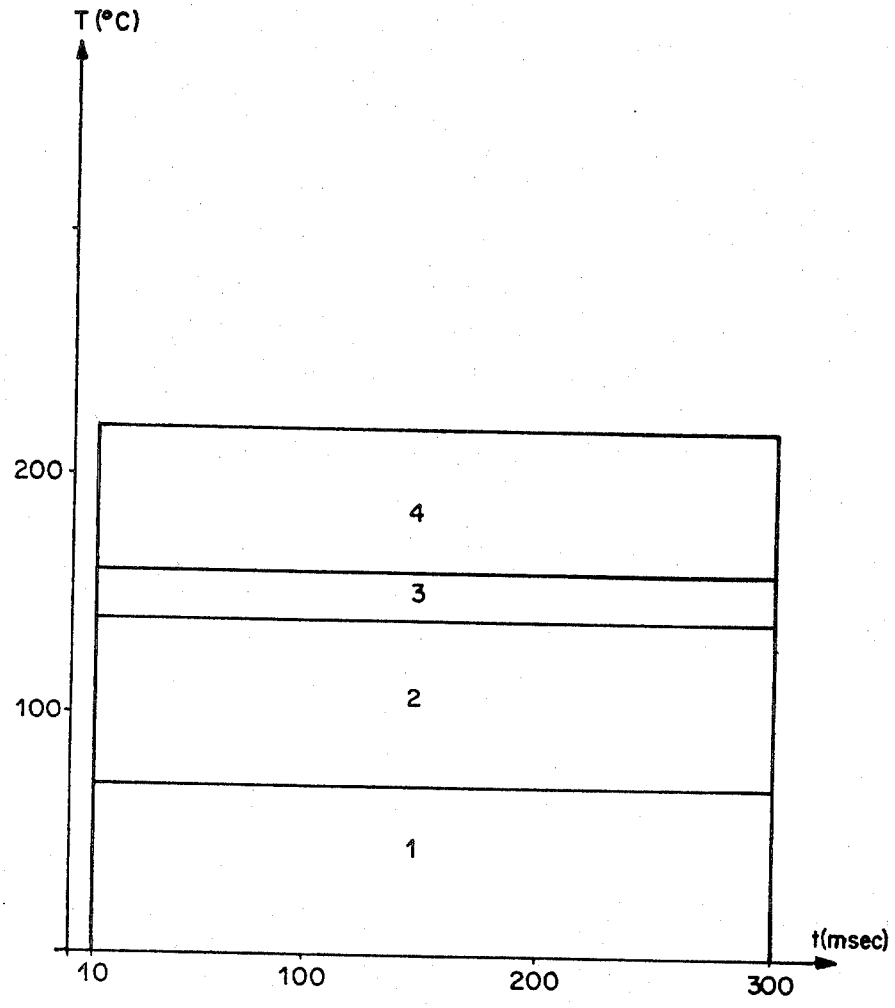
T (°C)
200
100
4
3
2
1
t(msec)
10
100
200
300

METHOD FOR THE MANUFACTURE OF A LAYER FROM A THERMOCHROME LACQUER, AND ITS USE

In the DE-AS No. 1181245 there is described a multi-layered copy paper, which consists at least of one carrier layer of paper, a ray-absorbing layer, and a thermochrome layer. The thermochrome layer contains a thermoplastic substance, for example ethylcellulose, as a film-forming means together with a mixture of a heavy metal salt wih butylphyrocatechin, or a water soluble heavy metal salt with thiourea. The copy paper is intended for contactless thermography with the aid of a source of rays, whereby the ray-absorbing layer permits a reduction of the radiated energy. However, the thermochrome layer of this kind will not readily adhere to non-porous, non-absorbant smooth surfaces and could become detached from the carrier layer or otherwise damaged or contaminated if heat was transferred thereto by means of a pressure head. Consequently, the possibilities of use of this thermochrome layer are very limited indeed.

It is a task of the present invention to devise a method for the manufacture of a thermochrome layer containing a metallic compound and an organic sulfur compound reactable with this metallic compound and acquiring a permanent dark discoloration upon exposure to heat, as well as a synthetic plastic material as a layer-forming material, which is also suitable to cover non-porous, non-absorbent smooth surfaces. It is a further task to create optical contrasts by contactless thermal transmission by means of a heating head without any contamination or damage occurring on these thermochrome layers manufactured from this lacquer. The ingredients suitable for their manufacture should, if necessary, have a long-term stability prior to processing, and the thermochrome layers manufactured therefrom should harden on their own at room temperature. Finally these layers should have particular properties which enable them to be applied to new uses.

The main task is solved in that the metallic compound includes a selected heavy metal or noble metal, and in that two components are used for the layer-forming material, these components forming a transparent synthetic plastic material which is stable when heated and which is compatible with the metallic compound, the sulfur compound and the reaction product thereof which is capable of acquiring the permanent dark discoloration.

For the manufacture of such thermochrome lacquers and layers manufactured therefrom, it has been shown suitable, if at least two ingredients, which have a long-term stability of their own are used, and which consist of mixtures, which contain a contrast-forming component, and a layer-forming means compatible therewith. The first ingredient may, for example, consist of a heavy metal compound, or a noble metal compound finely dispersed in a resin base, and the second ingredient may consist of a sulfur/carbon-covalent compound finely distributed and dispersed in a hardener for the resin base, setting free sulfur in ionized form, when heated beyond 70° C. Where only a small percentage of a hardener can be used, the sulfur/carbon-covalent compound may also be separately dispersed in a resin base, and the hardener may be used as a third ingredient which is stable per se.

The resin base may contain a prepolymerizate of a methacrylic acid dissolved in aromatic solution means, or a compound containing epoxy groups, and slowly hardening into epoxy resin, by way of a moderate exothermal reaction, whereby in the first case a diol, and in the second case a compound containing amine groups is used as a hardener.

The heavy metal compound, or the noble metal compound, should be an oxide not soluble in water or solutions, a salt, or a compound with an inorganic anion, or a compound with a monocarboxylic acid with 2, 8, 10, 12, 14, 16, 18, 20, 22 or 28 C-atoms, or a compound with a dicarboxylic acid, such as fumaric acid, or an adipic acid of the metals bismuth, copper, silver, gold, mercury, thallium, lead, vanadium, molybdenum, tungsten, rhenium, iron, cobalt, nickel, palladium, or platinum. As a sulfur/carbon-covalent compound a compound of the general formula

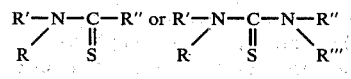

can be chosen, wherein R, R', R'', or R''' is: $CH_3$—, $CH_3$—, $CH_2$—, $CH_2$=CH—$CH_2$—,H—

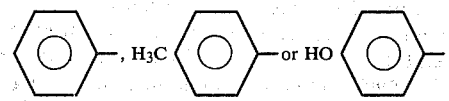

For the manufacture of thermochrome layers applied on smooth surfaces of plastic or metalized plastic to be described later, there should be used an intimate mixture of ingredients, which may be applied by screen printing. Such layers preferably have a thickness from ten to hundred μm, and they experience an irreversible local darkening, without the layer adhering in any manner whatever to the heating element, when contacted by the heating element heated to a temperature range from 140° to 220° C. during at most 10 to 300 milliseconds.

In an earlier document (DE Pat. No. 2842972) there is described payment means in card-form with optical markings, which represent value units, which are disposed between two protective layers not penetrable by visible light, and which are erasable or changeable by step-wise devaluation of the payment means through the supply of thermal energy, and wherein at least a portion of the payment means includes a thermochrome material.

One of the thermal layers can therefore be covered by a covering layer containing the thermochrome material, or may itself contain the thermochrome material.

The manufacture of thermochrome layers for this purpose presents particular problems. As the thermal energy for erasing the optical markings and for generating the thermographic dark coloring is often very limited, particular attention has to be paid to carefully matching the ingredients of the mixture of the lacquer required for the manufacture of such layers with the pressure conditions and the thickness of the layer. These dependencies will be explained in what follows by means of a figure of the drawing.

FIGURE

In this FIGURE there are represented regions, in which the thermochrome layers of the thermochrome lacquer are subjected to an irreversible black coloring upon contact with a heating head. In the diagram there is shown on the abscissa the contact-time in milliseconds, and in the ordinate the temperature of the printing head in degrees C. Within a time duration between 10 and 300 milliseconds there are delimited from below to above four zones, a predetermined layer thickness of 10 to 100 /μm being assumed for the thermochrome layers obtained by a screenprinting layering process.

Zones 1 and 2 are the so called forbidden zones, which extend over a region from 0° to 140° C. In the case of wet layers, in wich the darkening temperature of the thermochrome layers of the zone 1 lies in this region, the exothermal reaction of the mixture of the components required for their manufacture is so strong, that a dark coloring can already be observed when the layer hardens. The pot time of the mixtures for layes in the region of zones 1 and 2 is insufficient for the same reason. The temperature can reach up to 70° C. in such layers. They are thermally stable in an insufficient measure. The zones 3 and 4 lie in a region of the limits of the invention, within which, even during extended storage at room temperature, no darkening of the thermochrome layer occurs. For such components there are selected two-component resin systems, which generate, following mixture, an exothermal reaction limited to a temperature rise of 40° C., and which, at room temperature, harden within 30 to 60 minutes following formation of the layer, to a bone-dry state. The zone 3 extends over pressure head temperatures from 150°±10° C. It offers the best compromise between stability against unintended darkening, and the energy expended for the desired darkening. These layers are therefore particularly suitable for the card-shaped payment means described in further detail in examples 1 and 2.

For the pressure head temperatures from 160° to 220° C. disposed in zone 4, there are provided thermochrome layers of components showing a relatively low exothermal effect during reaction. They have a higher thermal stability. However, for the intended darkening, a higher thermal expenditure of energy is required.

The examples which follow illustrate the invention in further detail.

EXAMPLE 1

In this example, there is described the manufacture of thermochrome layers, which are suitable for the card-shaped payment means with optical markings, which can be devalued by contact with a heating element, and whose devaluation is indicated by a local darkening of the thermochrome layer. They are manufactured from a lacquer with two or three ingredients capable of being stored on their own in a screen printing process. Since for these purposes the heating energy of a heating element is limited to 150 to 400 mJ for a surface of 8 $mm^2$, and as the energy is further subdivided into energy for erasing the markings and into energy for generating the darkening process, the choice of components is of key importance in addition to the thickness of the layer.

The first ingredient consists of 10 parts by weight of a colorless pre-polymerizate of the methacrylic acid, 3 parts of lead stearate in finely dispersed forms having a particle size of at most 5 μm, which together are finely dispersed, for example in a spherical grinder.

The second ingredient contains 25 parts by weight of a colorless pre-polymerizate of the methacrylic acid, which is finely dispersed with 5 parts of thiobenzamid.

The third ingredient consists of a hardener with at least one diol.

Just prior to coating of a card-shaped payment means from a polyvinyl chloride plate with optical markings, there is manufactured a lacquer of 130 parts per weight of the first ingredient, 25 parts of the second ingredient, and 60 parts of the third ingredient in a grinder with three rollers. As in this case there is present a sufficient amount of a hardener for a mixture with a contrast-forming component, there is also available a dispersed mixture of the thiobenzamid as a second ingredient in the hardener and compatible therewith, there being present correspondingly more of the pre-polymerizate in the first ingredient.

The mixture can be diluted with a thinning agent up to 10% of the total mixture, for example a mixture of tolnol and xylol having a boiling point of 110° to 140° C. so as to obtain a suitable viscosity of the lacquer for the coating. It is supplemented, if desired with matting means or other substances for different effects. Subsequently it is applied in the known screen printing method to the side of the card bearing the optical markings, and allowed to harden during room temperature. This process takes at most an hour until the layer is bone-dry. In lieu of a lead stearate it is possible to use a soap of hard metal which is difficult to dissolve in water or solvents, and which is capable to form an irreversibly darkened metal sulfide compound with sulfur ions, when heated. As very fine layers are applied, the price of the corresponding portion of the heavy metal does not play an important part for this purpose. A monocarboxylic acid with 2, 8, 10, 14, 16, 18, 20, 22 or 28 C-atoms, or a dicarboxylic acid as well as a fumaric acid, or adipic acid can be used as a form of soap. Also suitable are oxides of these metals, or salts of noble metals, which form darkly colored sulfides. The soap or heavy metals must be finely dispersed, and should have a particle size of less than 5 μm. It can additionally act as a dispersing agent.

Thiourea can only be used to a limited extent as a sulfur-carbon covalent compound, as it is partly transformed to sulfocyanate when heated, and already reacts with certain heavy metal compounds at room temperature. It can therefore be dosed only with difficulty. Finally it is soluble in water and alcohol. On the other hand, thiobenzamid is most suitable, particularly, as it is obtainable in fine form with particle size of approximately 10 μm.

The binding means should only contain solvents, which have a boiling point of at least 110° C.

The thickness of the layer should be 10 to 100 μm optimally 15 μm. The thermochrome layer hardens already during room temperature and is stable when heated up to 130° C., when heat is applied only a very short time.

An irreversible darkening occurs during short time contact of the thermochrome layer preferably with a heating head heated to 150°±10° (zone 3 of the diagram) having a contact surface of 2×4 millimeters. Under those conditions a thermal energy of only about 300 mJ need be expended for destroying the markings and darkening of the thermochrome layer. The latter is accomplished in two reaction stages. At the stated temperature the sulfurcarbon covalent compound first splits off sulfide ions. The sulfide ions then join the heavy metal ions to yield a heavy metal sulfide, which has a dark color. These sulfides are very stable chemical compounds. The binder helps to realize sharp prints which do not run out. Furthermore this binder combination prevents adhesion of the heating head (used to apply pressure) to the thermographic layer. The heating heads remain clean and the layers smooth.

EXAMPLE 2

The thermochrome layers manufactured, according to this example, are intended for the same purposes, and for the same temperature of the heating head as those according to example 1. The first ingredient contains as a metal compound, a portion by weight of finely distributed basic bismuth nitrate, and a portion of a glycide ether hardening only very slowly, and having a small exothermic reaction. The second ingredient contains two parts of the gylcide ether and one part of thiobenzamide. Both parts are individually finely dispersed in a dispersion apparatus.

The third ingredient is formed by a diamin-cold hardener forming with the glycide ether a non-soluble epoxy resin.

Formation of this layer is accomplished by the screen print process by means of a lacquer of three equal parts of the three ingredients, as in example 1. The properties of the thermochrome layer manufactured in this manner are analogous to those of example 1. They can also be used for check cards, credit cards, identification cards, or entry cards of synthetic plastic material.

EXAMPLE 3

The first ingredient consists of ten parts per weight of the prepolymer of the methycrylic acid used in the first example, two parts of iron adipate, and one part of iron octoate, which are treated up to a particle size of at most 5 /μm in a spherical grinder, and are dispersed jointly. The second ingredient is formed by dispersion of 10 parts of the prepolymer used in the first component with 3 parts of N,N'-diphenyl-thioresin. The same hardener as in example 1 is used as a third ingredient.

The lacquer applied for the formation of a layer is manufactured in a dispersion-apparatus from 13 parts of each of the first and second ingredients, of 6 parts of the third ingredient, and, if necessary, from the solution mixture of up to 10% used in example 1. It can be applied in the same measure as that in example 1. But it can also be generated with, or without the addition of a suitable aromatic thinning means by means of a doctor blade, or in form of a lcqueer in an ejection molding process having layer thicknesses of less than 100 μm. In this manner there can be generated by the supply of heat layers on smooth metal surfaces or synthetic plastic surfaces, on housings of electrical or telephone apparatus, and on albums or book covers. The thermochrome layers, according to this example, fall, as far as their behavior under heat is concerned, into zones 3 or 4 of the diagram.

EXAMPLE 4

The first ingredient consists in this case of 10 parts of the prepolymerizate, according to example 1, and of 3 parts of copper laurate. The second ingredient contains 3 parts of prepolymerizate, and 1 part of phenyl thioresin. The third ingredient is formed by the hardener described in example 1. The ingredients 1 and 2 are dispersed finely separately.

the layer-forming lacquer consits of 15 parts of the first ingredient, of 4 parts of the second and third ingredients, respectively, and up to 10% of thinning means.

EXAMPLE 5

In a manner analogous to the previous examples, layers are formed from a first ingredient having 10 parts per weight of the pre-polymerizate, two parts nickel fumarate, and 1 part nickel-oxidehydrate, a second ingredient having 10 parts of pre-polymerizate, and 3, 8 parts N-Allyl thiocarbamide (thiosinamine) with the same hardener as before, by 13 parts being dispersed jointly in the first ingredient, 7 parts in the second ingredient, and 3, 5 parts in the third ingredient. The layers of this lacquer behave under heat according to the lowest portion of zone 3 of the diagram. Here a thermal energy of 210 mJ is required for darkening a surface of 8 $mm^2$ at a contact time of about 160 milliseconds, and a temperature of 200° C. of the heating element.

The thermochrome layers, according to examples 3 to 5 have, apart from their behavior during heat, properties similar to those according to example 1. They are transparent, and in view of their low layer thickness of at most 100 μm, show at most a hardly discernible discoloration due to their metallic compounds. They form on the heated location a sharp and contrast-rick marking. They are particularly suitable for coating of small surfaces, and for imitation of hot-stamped foils. The best results are obtained, if both the weight ratio of the prepolymer to the hardener, as well as the heavy meatal compound to the sulfur/carbon-covalent compound is stochiometric. The thermochrome layers from these compounds possess very good mechanical and chemical stability, moisture resistance, and an adhesiveness on different surfaces.

The aforesaid thermochrome layers contain sulfur/-carbon-covalent compounds, which split off sulfur ions only during heating and which, contrary to the known two-component polymers; are stable as binding means at high temperatures. They are therefore particularly stable, wear resistant, and do not adhere to the heating elements in the zones designated 3 and 4 in the diagram.

I claim:

1. In a method of coating a smooth surface with a thermochromic, water-resistant layer, with the aid of two reaction components being substantially free of any water and storable separately, and with the aid of a film-forming component and a hardener, one reaction component being an organic sulfur compound splitting off sulfur in ionized form only upon being heated above 70° C., and thereby assuming a dark discoloration, the other reaction component being a metal compound produced with the aid of a resin base selected from the group consisting of a methacrylic acid dissolved in aromatic solution means and a compound containing epoxy groups said metal compound being selected from the group consisting of an oxide, an inorganic salt, or a soap of a monocarboxylic acid wih 2, 8, 10, 12, 14, 16, 18, 20, 22 or 38 C-atoms, or a dicarboxylic acid metal compound wherein the metal is selected from the group consisting of bismuth, copper, silver, gold, mercury, thallium, lead, vanadium, molybdenum, tungsten, rhenium, iron, cobalt, nickel, palladium, or platinum, the steps comprising:

dispersing said metal compound in said resin base, mixing said reaction components with said film-forming component and said hardener to yield a multi-component substantially transparent resin, suitable of being used for screen printing, thereby setting off an exothermal reaction generating a temperature not higher than about 40° C., and applying said multi-component resin to said surface and allowing it to harden thereon at room temperature for at least 30 minutes, whereby said multi-component resin is hardened to a substantially bone-dry state.

2. In a method as claimed in claim 1 further comprising the step of producing said one component by dispersing said sulfur compound in said hardener.

3. In a method as claimed in claim 1, wherein said dicarboxylic acid is selected from the group consisting of fumaric acid and adipic acid.

4. In a method as claimed in claim 1, wherein said hardener for the prepolymerizate of a methacrylic acid is selected from the group consisting of at least one diol and the hardener for the compound containing epxoy groups is a compound of amine groups.

5. A method according to claim 1, wherein the organic sulfur compound splitting off sulfur, when heated, is a compound of the general formula

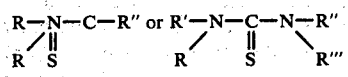

wherein R, R', R'' or R''' is: $CH_3$—, $CH_3$—$CH_2$—, $CH_2$=CH—$CH_2$—, H—

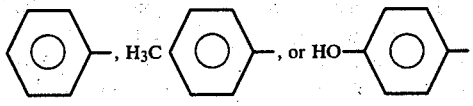

6. In a method for coating a smooth surface with a thermochromic resin, the steps comprising, (1) preparing a first component including mixing a. a metal compound capable of forming a dispersion, selected from the group consisting of an oxide, an organic salt, or a soap of a monocarboxylic acid with 2, 8, 10, 12, 14, 16, 18, 20, 22 or 38 C-atoms, or a dicarboxylic acid metal compound where the metal is selected from the group consisting of bismuth, copper, silver, gold, mercury, thallium, lead, vanadium, molybdenum, tungsten, rhenium, iron, cobalt, nickel, palladium, or platinum, b. a resin base formed from a prepolymerizate of a methacrylic acid or a slowly hardening glycidyl ether, and c. dispersing said metal compound in said resin base, (2. ) preparing a second component including a. an organic sulfur compound provided by by an organic covalent compound of sulfur and carbon substantially commencing to split off sulfur in ionized species only above about 70° C., b. a resin base formed from a prepolymerizate of methacrylic acid or a slowly hardening glycidyl ether, and c. a hardener formed from a compound having diol or amine groups, (3) mixing the first component, the second component, and said hardener to substantially transparent composition, (4) applying this mixture of multicomponent resin composition to a sheet type identification or payment means with a layer thickness of from about 10 to 100 microns for providing a marking capable of being developed by heat treatment and whereby the organic sulfur compound generates a dark discoloration, and (5) hardening the applied mixture at room temperature.

* * * * *